US006683237B2

(12) United States Patent
Christou

(10) Patent No.: US 6,683,237 B2
(45) Date of Patent: Jan. 27, 2004

(54) MUSICAL INSTRUMENT SUPPORT

(76) Inventor: John Christou, 70 Sherman Avenue North, Hamilton, Ontario (CA), L8L 6M2

( * ) Notice: Subject to any disclaimer, the term of this patent is extended or adjusted under 35 U.S.C. 154(b) by 0 days.

(21) Appl. No.: 10/151,890

(22) Filed: May 22, 2002

(65) Prior Publication Data

US 2003/0217635 A1 Nov. 27, 2003

(51) Int. Cl.[7] ..... G10D 3/00
(52) U.S. Cl. ..... 84/327; 84/421
(58) Field of Search ..... 84/327, 421

(56) References Cited

U.S. PATENT DOCUMENTS 4,256,007 A * 3/1981 Streit ..... 84/421
5,817,961 A * 10/1998 Beck ..... 84/327
6,252,150 B1 * 6/2001 Johnson ..... 84/327

* cited by examiner

*Primary Examiner*—Kimberly Lockett

(57) ABSTRACT

A musical instrument support for attaching to an instrument, said support comprises a resilient continuous frame including at least two U shaped clamp portions making contact with an instrument at guitar contact areas for releasably and resiliently biassing said support to an instrument wherein said clamp portions for engaging with a front and back side of an instrument; and said frame further including at least two U shaped base portions making contact with an instrument at second contact areas for resting said support onto a persons thigh, such that said base portions rest comfortably and securely on a persons thigh and maintains said instrument in a desired playing position when said support is clamped to an instrument.

6 Claims, 5 Drawing Sheets

100
102
104
106
108
110
112
114
116
120
122
124
126
140
152
4
5

MUSICAL INSTRUMENT SUPPORT

FIELD OF THE INVENTION

The present invention relates to musical instruments and more particularly relates to an instrument support for musical instruments such as guitars and basses.

BACKGROUND OF THE INVENTION

It is well recognized that various instruments such as guitars and basses and the like tend to be too heavy and cumbersome to be comfortably hand held for long periods. It is therefore become a common practise to support their structure and weight by means of a cord strap or sling that is looped around the back of a players neck. This arrangement supports the instruments weight and positions the instrument at a comfortable height and orientation for playing.

With the ever increasing interest in research and development in the field of ergonomics, many new consumer friendly improved designed products are steadily being introduced to world wide commercial markets including the manufacturing and distribution of guitar accessories, all with the intention to expedite productivity, increase satisfaction and to alleviate most of the more common symptoms leading to personal injury such as tendinitis, back pain and neck and shoulder tension caused by over exertion, strain and from daily repetition.

With the exception to many new improvements in innovations such as electrical pick-ups, strings and other hard wares. The manufacturing of acoustic and more over solid body electrical guitars have remained relatively unchanged. Now with the emphasis leaning more towards new experimental body and neck configurations, exotic colours and with the introduction of hardwoods and synthetics construction materials. The excessive weight of the solid body, and the awkwardness of the hollow body guitars still remain an obstacle and continues to present many challenges for the modern guitar player.

Besides variations in colours, patterns and materials and widths in construction. Guitar straps have remained the conventional means to support a solid body or acoustic guitar in standing or preferably sitting playing position.

Therefore, it is desirable to have an improved musical instrument support that removes the instruments weight from the players neck and shoulder area and provides for a stable and reliable support of the instrument while it is being played at minimal cost.

SUMMARY OF THE INVENTION

The present invention a musical instrument support for attaching to an instrument, said support comprises a) a resilient continuous frame including a clamping means for releasably and resiliently biassing said support to an instrument wherein said clamping means engaging with a front and back side of an instrument; and b) said frame further including a base means for resting said support onto a persons thigh, such that said base means rests comfortably and securely on a persons thigh and maintains said instrument in a desired playing position when said support is clamped to an instrument.

Preferably wherein said clamping means for engaging with a front and back side of said instrument and said base means including base portions for engaging with a persons thigh.

Preferably wherein said clamping means preferably including at least two U shaped clamp portions making contact with an instrument at guitar contact areas.

Preferably wherein said base portions including at least two U shaped base portions making contact with an instrument at second contact areas.

Preferably wherein said frame defining a saddle shape configuration with said U shaped base and U shaped clamp portions continuously connected to form said saddle configuration.

Preferably wherein said clamp portions define an angle theta relative to a centre plane of said saddle.

Preferably wherein said frame preferably being made of a continuous piece of metal wire having resiliency and also capable of being permanently deformed.

Preferably wherein said clamp portions define a clamp spacing C relative each other which can be adjusted by permanently deforming said frame by urging clamp portions apart or together.

Preferably wherein said base portions define a base spacing B relative each other which can be adjusted by permanently deforming said frame by urging base portions apart or together.

Preferably wherein said clamp portions covered with a protective wire sheath to protect from damaging an instrument when said support is in a clamped position.

Preferably wherein said base portions covered with a deformable base sheath to protect provide a large base contact area for making contact with a thigh and providing a deformable and soft support material.

Preferably wherein said base sheath partially covered with a cover to protect provide a wear resistant and non slip base contact area.

BRIEF DESCRIPTION OF THE DRAWINGS

The present invention will now be described by way of example only with reference to the following drawings.

DETAILED DESCRIPTION OF THE PREFERRED EMBODIMENT

The present invention a musical instrument support is shown generally as 100 in the attached Figures and more specifically includes the following major portions, namely wire frame 110 having clamp portions 102 and base portions 104.

Wire frame 110 preferably is made up of a single continuous, endless metallic wire which defines the saddle like shape of musical instrument support 100. Preferably wire frame 110 is made of mild carbon steel, however it is possible that wire frame 110 may be made of other materials including aluminum, suitable plastics, reinforced plastics and/or other materials or fibres known in the art.

Figures 6, 7, 8:
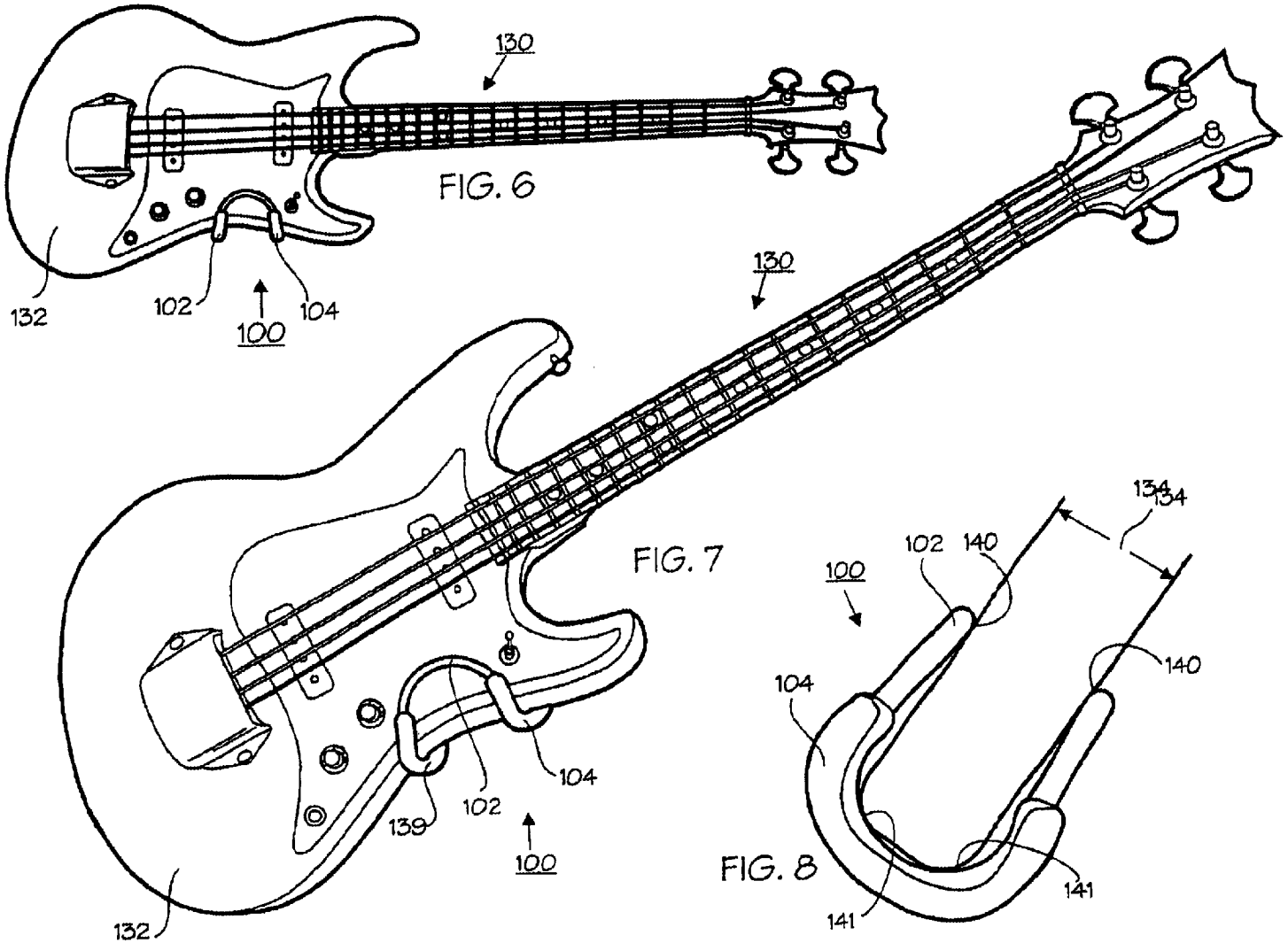
FIG. 6 is a schematic plan view of the present invention a musical instrument support showing deployed on an electric guitar.
FIG. 7 is a schematic perspective view of the present invention a musical instrument support deployed on an electric guitar.
FIG. 8 is a schematic partial side elevational view of the present invention a musical instrument support shown deployed on an electric guitar.

Clamping portions 102 preferably include a wire frame 110 which is circular in cross section covered with a wire sheath 112 which would be a soft more pliable material in order to avoid damaging of an instrument when clamp portions 102 make contact with a guitar body at guitar contact area 140 as shown in FIG. 8. Preferably clamp portions 102 include steel wire frame 110 covered with a coating of latex rubber (or other similar materials) for wire sheaths 112.

Figures 1, 2, 3, 4, 5:
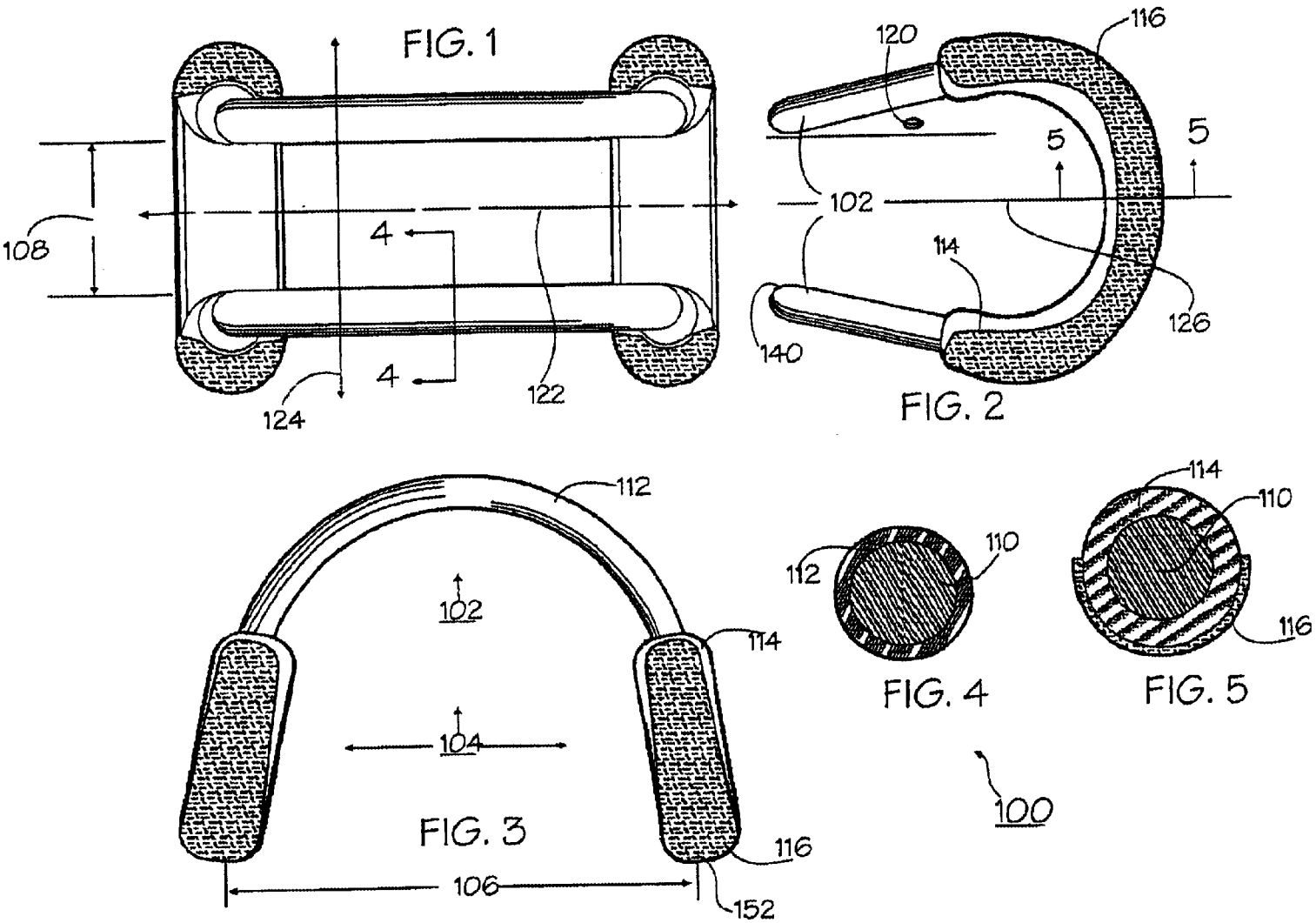
FIG. 1 is a schematic top plan view of the present invention a musical instrument support.
FIG. 2 is a schematic end plan view of the present invention a musical instrument support.
FIG. 3 is a schematic side plan view of the present invention a musical instrument support.
FIG. 4 is a schematic cross-sectional view of the plan portion of the musical instrument support taken along lines 4—4 of FIG. 1.
FIG. 5 is a schematic cross-sectional view taken through the base portion taken along lines 5—5 of FIG. 2.

There is no reason why other cross-sectional shapes of wire frame 110 cannot be adopted such as square, triangular, hexagonal, however the preferred shaped is the circular cross-sectional shape as shown in FIGS. 4 and 5.

It is evident from the drawings that musical instrument support 100 defines two clamp portions 102 which are spaced apart as defined by clamp spacing C 108 as shown in FIG. 1. Clamp spacing C shown as 108 is dependent upon the guitar thickness T shown as 134 in FIG. 8. The larger guitar thickness T 134, the larger the clamp spacing C 108 must be.

Wire frame 110 is selected to have a combination of properties including resiliency and yet be shape deformable to provide for some adjustability in clamp spacing C 108 shown in FIG. 1.

Clamp portions 102 also define an angle theta shown as 120 in FIG. 2 relative to a centre plane 126. As best seen in FIG. 2, clamp portions 102 together with base portions 104 provide for a substantially U shaped profile which aids in providing for resiliency or spring like qualities in the clamp portions 102 and ensures that there is a specific guitar contact area 140 where clamp portions 102 make contact with a guitar body 132.

Referring now to FIG. 5 which is a cross-sectional view taken along lines 5—5 of FIG. 2, one can see that wire frame 110 extends centrally along the length of base portion 104 and is covered with a base sheath 114 which in turn is partially covered with a cover 116.

Figure 9:
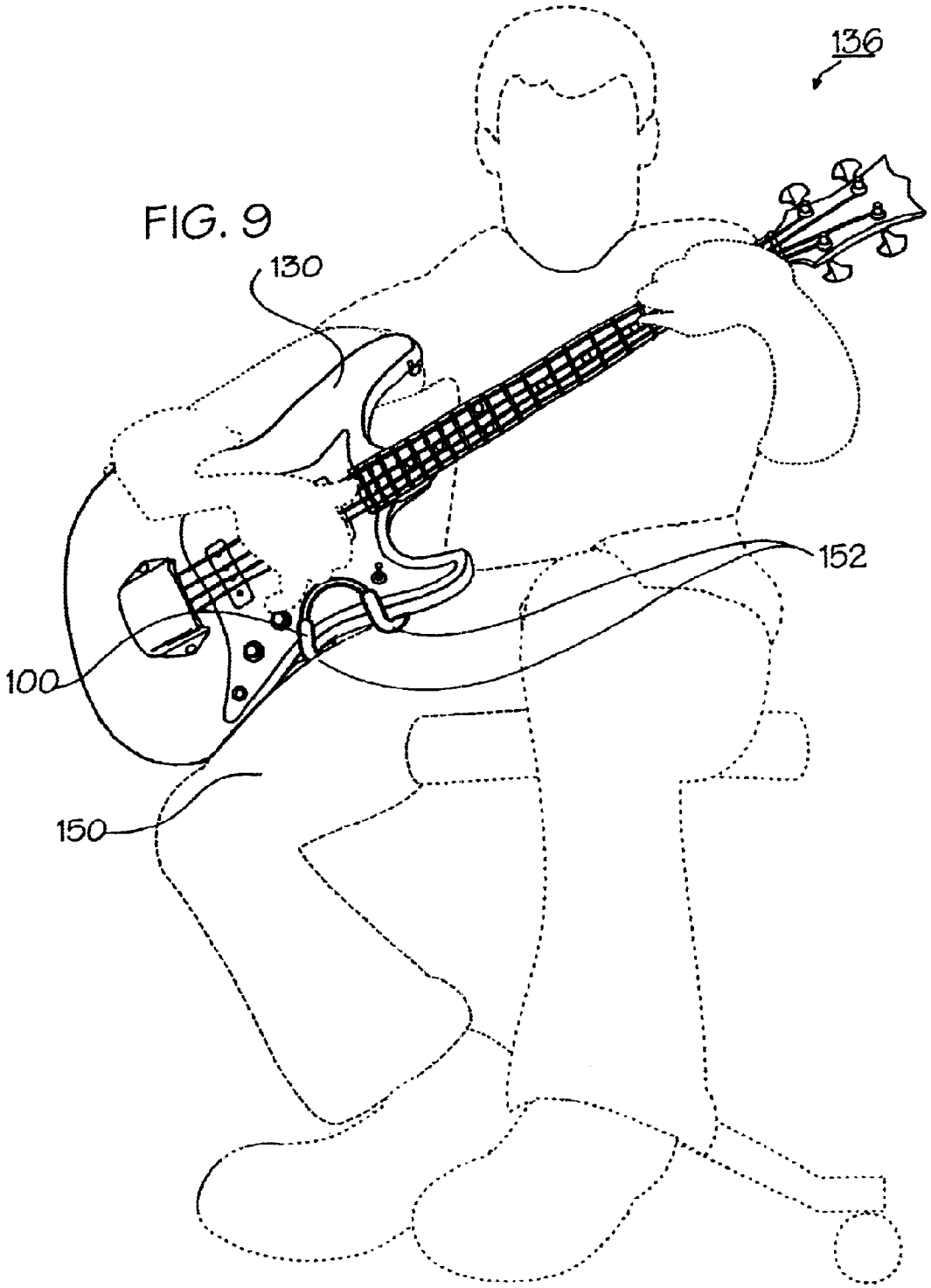
FIG. 9 is a schematic perspective view of the present invention a musical instrument support shown deployed on an electric guitar and how it is positioned on a persons thigh together with a player.
Figure 10:
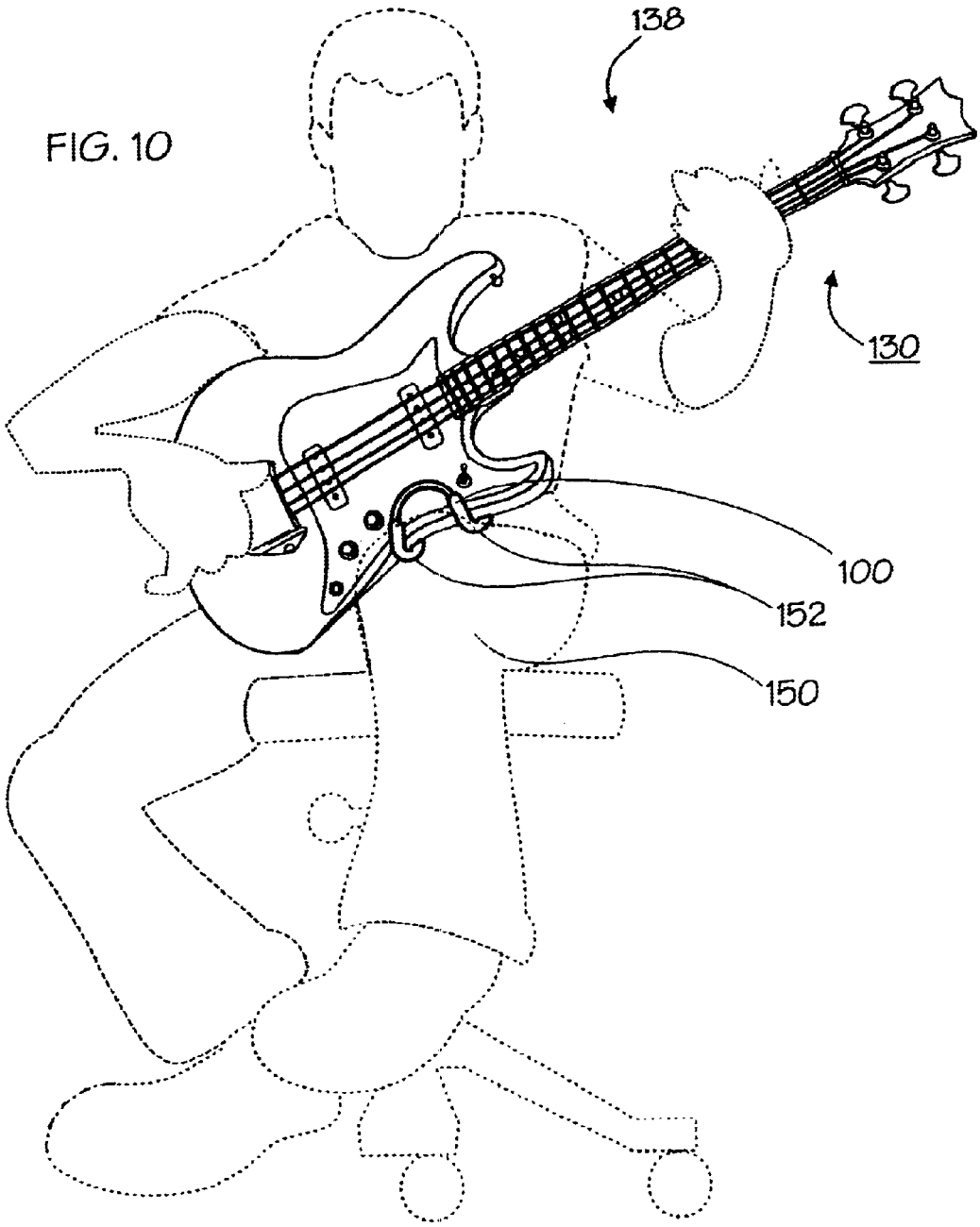
FIG. 10 is a schematic perspective view of the present invention a musical instrument support shown deployed on an electric guitar and how it is positioned on a persons thigh together with a player.
Figure 11:
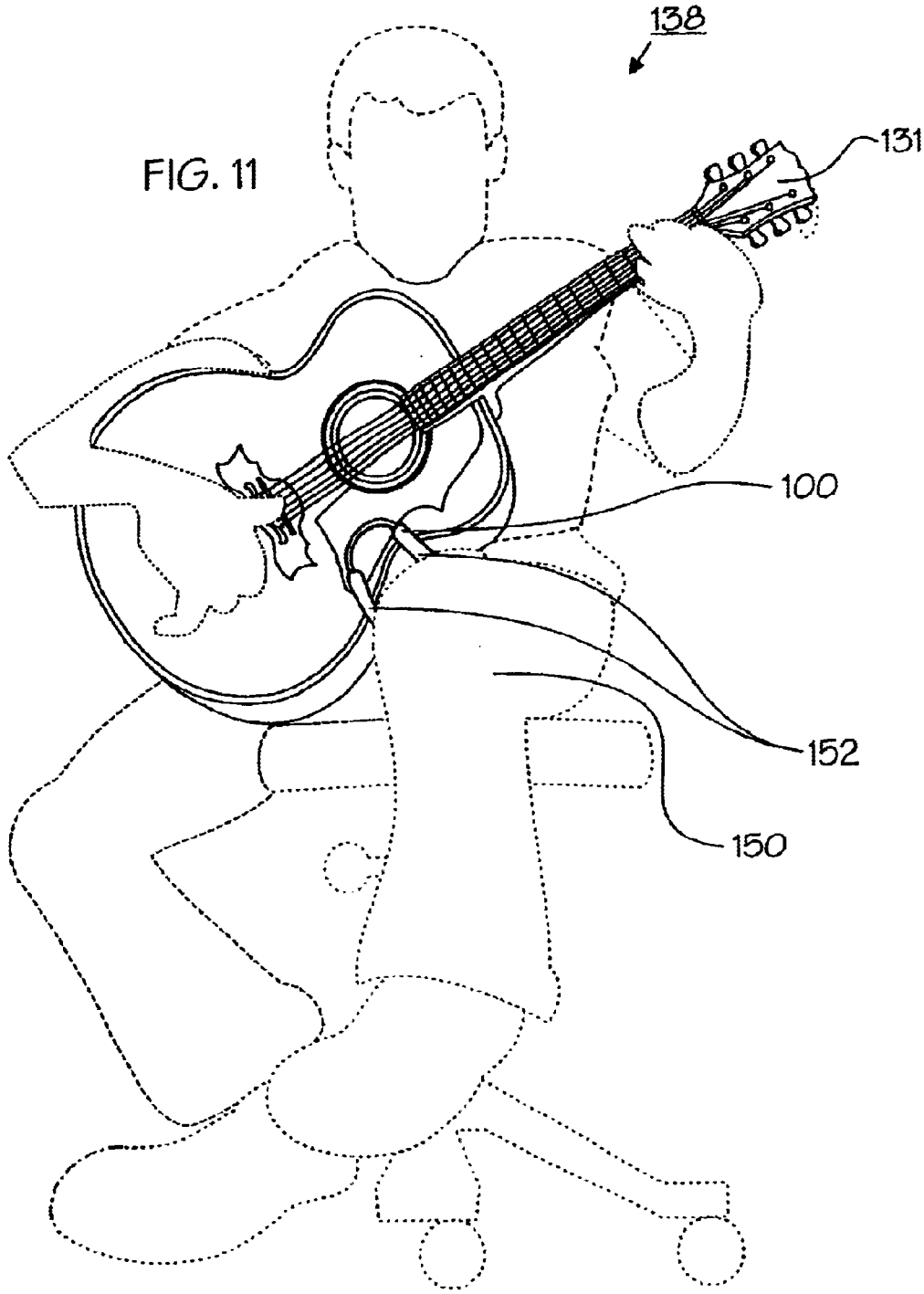
FIG. 11 is a schematic perspective view of the present invention a musical instrument support shown deployed on an acoustic guitar and how it is positioned on a persons thigh together with a player.

Base portions 104 define a base contact area 152 which is the section of base portion 104 which makes contact with a thigh 150 of the person using musical instrument support 100 as shown in FIGS. 9, 10 and 11. In order to ensure that base contact area 152 of base portions 104 is as broad and as comfortable to the user as possible, base sheath 114 is preferably thicker in size than wire sheath 112 and constructed of softer material. Optionally base sheath 114 is in turn covered with cover 116 which is a wear and/or abrasion resistant material having a non-slip outer surface to ensure that musical instrument support 100 is firmly supported on thigh 150.

By way of example only base sheath 114 could be made of open or closed cell foam type materials wherein cover 116 could be made of a neoprene type rubber material. The distance between base portions 104 is defined as base spacing B shown as 106 in FIG. 3 and is dependent upon the overall size of musical instrument support 100, but also can be adjusted by deformably urging base portions 104 apart until the desired based spacing B 106 is achieved. Therefore, wire frame 110 is chosen having material properties giving it resiliency, but also given enough force permanently deformable to maintain a preselected shape and ultimately a pre-selected base spacing B shown as 106 in FIG. 3.

It will be apparent to those skilled in the art that musical instrument support 100 possibly could be manufactured from a one piece injection mould and be made entirely of plastic with properties providing for the necessary resiliency and deformability. In practice it has been shown that a steel wire frame 110 covered with plastic type materials provides the necessary material property characteristics to provide for the resiliency required for clamping portions 102 and yet the deformability required for base portions 104 and clamping portions 102.

Cover 116 which is an abrasion and/or slip resistant cover and is optional depending upon the material selection for base sheath 114 and costs considerations.

Musical instrument support 100 would be available in standard sizes to accommodate various types of instruments including electric guitars, basses, acoustic guitars and other stringed instruments which are similarly positioned.

IN USE

Referring now to FIGS. 6 through 11, the present invention musical instrument support 100 is shown deployed on an electric guitar 130 in FIGS. 6, 7, 8, 9 and 10 and on an acoustic guitar 130 in FIG. 11. Musical instrument support 100 is shown deployed on an electric guitar 130 as shown in FIGS. 6, 7 and 9. Musical instrument support 100 is deployed onto the guitar saddle area 139 as best shown in FIGS. 6 and 7 of a guitar body 132. Firstly, a musical instrument support 100 sized according to the guitar thickness T 134 is chosen so that clamp portion 102 makes contact with guitar body 132 at guitar contact area 140 and second contact area 141. Clamp portions 102 resiliently bias against the front and back of the guitar saddle area 139 of the guitar body 132 as shown in FIG. 8. In other words clamp spacing C 108 shown in FIG. 1 is somewhat smaller in dimension or narrower than guitar thickness T 134, such that the clamp portions 102 are forcibly spread apart in order to fit over guitar thickness T 134. When in position, shown in FIGS. 6, 7 and 8, as already indicated, clamp portions 102 impart a resilient biasing force against a guitar body 132 thereby maintaining musical instrument support 100 in the correct position. Wire sheath 112 and base sheath 114 covering wire frame 110 protects against any surface injury to guitar body 132.

There is a certain amount of adjustability in musical instrument support 100 in that the clamp spacing C 108 can be manually adjusted to be some what narrower or larger than in the as received condition. Clamp spacing C shown as 108 in FIG. 1 can be manually enlarged by pulling apart clamp portions 102 and permanently deforming wire frame 110 and/or can be squeezed together again permanently deforming wire frame 110. Therefore, instrument support 100 can accommodate a number of different guitar thicknesses T 134.

In regard to base spacing B shown as 106 in FIG. 3, note that the base contact area 152 rests on thigh 150 of a person using musical instrument support 100. Base spacing B 106 is adjustable by deforming base portions 104 either outwardly or inwardly by permanently deforming wire frame 110. Depending on the size of the thigh 150 and an individual players preference, base spacing B 106 may be selected by the player which is most comfortable for their use. FIG. 9 shows the musical instrument support 100 attached to an electric guitar 130 and being used in a first playing position 136.

FIG. 10 shows musical instrument support 100 deployed on electric guitar 130 which is used in a second playing position 138. In each case base portions 104 makes contact with the thigh at base contact area 152. Normally a portion of the thigh 150 is deformed and bulges in between base portions 104 thereby ensuring that electric guitar 130 is securely supported and does not move longitudinally from the playing position. In addition base sheath 114 of base portions 104 deforms and tends to flatten when weight is applied thereby additionally increasing the surface contact area 152 of base portions 104 when weight is applied.

Furthermore the U shaped design of base portion 104 allow instrument or electric guitar 130 to rock back and forth on a person thigh, but yet not move longitudinally along longitudinal direction 132. In this manner electric guitar 130 can be positioned at various angles with respect to the body of the player, however remain longitudinally stationary.

It should be apparent to persons skilled in the arts that various modifications and adaptation of this structure described above are possible without departure from the spirit of the invention the scope of which defined in the appended claim.

I claim:

1. A musical instrument support for attaching to an instrument, said support comprising;

a) a resilient continuous frame including a clamping means for releasably and resiliently biassing said support to an instrument wherein said clamping means engaging with a front and back side of an instrument;

b) said frame further including a base means for resting said support onto a persons thigh, such that said base means rests comfortably and securely on a persons thigh and maintains said instrument in a desired playing position when said support is clamped to an instrument;

c) wherein said clamping means for engaging with a front and back side of said instrument and said base means including base portions for engaging with a persons thihg;

d) wherein said clamping means preferably including at least two U shaped clamp portions making contact with an instrument at guitar contact areas;

e) wherein said base portions including at least two U shaped base portions making contact with an instrument at second contact areas; and f) wherein said frame defining a saddle shape configuration with said U shaped base and U shaped clamp portions continuously connected to form said saddle configuration.

2. The musical instrument support claimed in claim 1, wherein said clamp portions define an angle theta relative to a centre plane of said saddle.

3. The musical instrument support claimed in claim 1 wherein said frame preferably being made of a continuous piece of metal wire having resiliency and also capable of being permanently deformed.

4. The musical instrument support claimed in claim 1 wherein said clamp portions define a clamp spacing C relative each other which can be adjusted by permanently deforming said frame by urging clamp portions apart or together.

5. The musical instrument support claimed in claim 1 wherein said base portions define a base spacing B relative each other which can be adjusted by permanently deforming said frame by urging base portions apart or together.

6. A musical instrument support for attaching to an instrument, said support comprising;

a) a resilient continuous frame including a clamping means for releasably and resiliently biassing said support to an instrument wherein said clamping means engaging with a front and back side of an instrument;

b) said frame further including a base means for resting said support onto a persons thigh, such that said base means rests comfortably and securely on a persons thigh and maintains said instrument in a desired playing position when said support is clamped to an instrument;

c) wherein said clamping means for engaging with a front and back side of said instrument and said base means including base portions for engaging with a persons thigh;

d) wherein said clamping means preferably including at least two U shaped clamp portions making contact with an instrument at guitar contact areas; and e) wherein said clamp portions covered with a protective wire sheath to protect from damaging an instrument when said support is in a clamped position.

* * * * *